United States Patent [19]

Wagner

[11] 4,154,890

[45] May 15, 1979

[54] PROCESS FOR IMPARTING FLAME RETARDANT PROPERTY TO CELLULOSIC CONTAINING MATERIALS

[75] Inventor: George M. Wagner, Lewiston, N.Y.

[73] Assignee: Hooker Chemicals & Plastics Corp., Niagara Falls, N.Y.

[21] Appl. No.: 761,936

[22] Filed: Jan. 29, 1977

Related U.S. Application Data

[63] Continuation-in-part of Ser. No. 537,524, Dec. 30, 1973, abandoned, which is a continuation-in-part of Ser. No. 385,782, Aug. 6, 1973, Pat. No. 3,860,439, which is a continuation-in-part of Ser. No. 244,574, Apr. 17, 1972, Pat. No. 3,864,155.

[51] Int. Cl.[2] ..... B32B 9/00

[52] U.S. Cl. ..... 428/276; 427/337; 427/341; 427/390 D; 428/920; 428/921

[58] Field of Search ..... 427/337, 341, 390 D; 428/DIG. 920, DIG. 921, 276

[56] References Cited

U.S. PATENT DOCUMENTS

| | | | |
|---|---|---|---|
| 2,772,188 | 1/1956 | Reeves et al. | 29/25.35 |
| 3,096,201 | 7/1963 | Coates et al. | 427/341 |
| 3,310,419 | 3/1967 | Wagner | 427/341 |
| 3,310,420 | 3/1967 | Wagner | 427/341 |
| 3,607,356 | 9/1971 | Beninate | 428/270 |
| 3,775,155 | 11/1973 | Eggenweiler et al. | 427/374 R |
| 3,784,356 | 1/1974 | Wagner | 8/196 |

*Primary Examiner*—Ronald H. Smith
*Assistant Examiner*—Janyce A. Bell
*Attorney, Agent, or Firm*—Peter F. Casella; William J. Crossetta, Jr.

[57] ABSTRACT

A process for imparting flame retardant property to cellulosic containing materials comprising the steps;

(1) treating the cellulosic containing material with a solution containing poly (hydroxy organo) phosphonium cation;

(2) exposing the treated cellulosic material to an atmosphere containing ammonia to polymerize the phosphonium compound;

(3) treating the cellulosic material containing the polymerized phosphonium compound with a solution containing a poly (hydroxy organo) phosphonium salt and a nitrogen containing compound copolymerizable with said phosphonium halide; and p1 (4) heat curing the phosphonium salt composition.

11 Claims, No Drawings

PROCESS FOR IMPARTING FLAME RETARDANT PROPERTY TO CELLULOSIC CONTAINING MATERIALS

CROSS-REFERENCE TO RELATED APPLICATIONS

The present case is a continuation-in-part of U.S. Ser. No. 537,524, now abandoned, filed Dec. 30, 1973 which is a continuation-in-part of U.S. Ser. No. 385,782 filed Aug. 6, 1973, now U.S. Pat. No. 3,860,439 issued Jan. 14, 1975 which in turn is a continuation-in-part of U.S. Ser. No. 244,574 filed Apr. 17, 1972, now U.S. Pat. No. 3,864,155, issued Nov. 5, 1974, which are hereby incorporated by reference.

BACKGROUND OF THE INVENTION

The present invention relates to an improved process for rendering cellulosic containing materials more durably flame retardant without sacrificing the "hand" the fabric had prior to treatment with the flame retarding compositions. Further the invention relates to imparting flame retardant characteristic or property to easy care fabrics.

In the past the flame retarding treatment of a fabric with a processing sequence of application of tetrakis (hydroxy methyl) phosphonium hydroxide to the fabric and curing with ammonia resulted in initially flame retarding cellulose containing textile materials. This treatment, however, when applied to blends of cellulosic materials with synthetic fibers leaves much to be desired by way of durability to home washings. Nor does this sequence impart sufficient wash and wear properties to be of consumer interest. Accordingly, treatment of blended fabrics with this process has not enjoyed commercial success. When a cellulose blended fabric is treated with a formulation such as tetrakis (hydroxy methyl) phosphonium salt with urea and trimethylol melamine and is subsequently cured by the application of heat, durable flame retardancy is imparted to the fabric and the fabric has desirable wash and wear properties. Unfortunately however, the "hand" of the resulting fabric is highly undesirable, the fabric being very stiff and harsh to the users skin.

Applicant has found that through the process of the present invention, a desirable "hand" may be retained by the fabric while imparting thereto good wash and wear properties together with durable flame retardancy.

Various references teach the imparting of flame retardant characteristics to cellulosic materials such as U.S. Pat. No. 3,607,356 as well as U.S. Pat. No. 2,983,623. U.S. Pat. No. 3,421,923 describes a process of flame proofing cellulosic containing textiles, wherein the textile material is impregnated with an aminoplast and then impregnated in an aqueous bath containing tetrakis (hydroxy methyl) phosphonium chloride.

U.S. Pat. No. 3,684,559 teaches a method of rendering cellulosic fabrics fire resistant by the attachment to the fibers of a resinous product formed by the treatment of a product of reaction of anhydrous ammonia and a phosphoric acid anhydride. U.S. Pat. No. 3,685,974 teaches flame retardant compositions which are prepared by reacting phosphoryl chloride with ammonia in an aqueous system. U.S. Pat. No. 3,644,140 teaches a method for utilizing certain phosphonomide flame retardant compositions on cellulosic materials. U.S. Pat. No. 3,436,250 teaches a method of imparting flame resistance to cellulosic materials by treating them with an aqueous solution of a composition containing a condensed phosphoric acid and a tertiary amine. U.S. Pat. No. 3,819,580 teaches a method of imparting flame retardant characteristics to cellulosic materials employing soluble methylol phosphine adducts. U.S. Pat. No. 3,772,068 teaches a similar method wherein the solution contains a tetrakis (hydroxy methyl) phosphonium salt. U.S. Pat. No. 3,745,191 relates also to a similar process employing methylol phosphine adducts which contain halogen atoms attached to an aromatic carbon. Comparable processes are also taught in U.S. Pat. Nos. 3,791,854; 3,600,219; 3,681,124; 3,692,559 and 3,669,725.

SUMMARY OF THE INVENTION

The invention is concerned with a process for imparting flame retardant property to cellulose containing materials comprising the steps:

(1) treating the cellulose containing material with a solution containing poly (hydroxy organo) phosphonium cation;

(2) exposing the treated cellulosic material to an atmosphere containing ammonia to polymerize the phosphonium compound;

(3) treating the cellulosic material containing the polymerized phosphonium compound with a solution containing a poly (hydroxy organo) phosphonium salt and a nitrogen containing compound copolymerizable with said phosphonium salt and (4) heat curing the phosphonium salt composition.

The invention can best be described as a multiple step process for applying phosphorus containing compositions to cellulosic containing materials. Difficulties have been associated with many previously employed fire retardant imparting compositions and processes for the treated materials were unable to meet the stringent government standards (Department of Commerce Standard FF-3-71) which require that the treated materials withstand at least fifty cycles of home washing and drying. Further, even if the treated materials could meet the government standards, the materials did not have a desirable hand and/or the materials treated did not have durable easy care characteristics. It is through the combination of steps as proposed in the present invention that all of these qualities can be obtained.

In the first step of the present invention there is an application of one type of polymerizable composition which can conveniently be identified as $THP^+/NH_3$ step. The application of this phosphorous composition is described in more detail below.

In accordance with a preferred mode of carrying out the improved process of this invention, an aqueous solution of poly (hydroxy organo) phosphonium cation containing from about 10 to 40% by weight of poly (hydroxy organo) phosphonium cation and having a pH of from about 2 to about 9 is prepared and used to impregnate a cellulose-containing material; the impregnated material is dried to about 0 to about 8% moisture, the dried material is aerated substantially immediately after leaving the drier by directing a current of air through the material, preferably by suction, said material is then exposed for at least about 5 to less than about forty-five seconds and preferably for about 15 to about 30 seconds to an atmosphere containing at least about 50% by volume of ammonia, and preferably from about 70 to about 95% of gaseous ammonia, and the material is contacted substantially immediately after leaving the curing step with water preferably in the form of a fine water spray, in an amount sufficient to provide a pick-up of from about 10 to about 40% by weight of water. The thus treated material containing an insoluble polymer of the phosphonium compound in and on the material is scoured, washed and dried.

The treatment of the dried impregnated material with ammonia, i.e., the curing step, is carried out in an enclosed chamber wherein the impregnated material is exposed to a gaseous atmosphere containing a high concentration, i.e., above about 50 percent by volume, of ammonia. The material is preferably passed into and out of the chamber, in a continuous manner and at a relatively high speed, so that the material is exposed to the ammonia atmosphere for at least 5 seconds and preferably from about 15 to about 30 seconds.

The improved process of this invention may utilize the process sequences disclosed in the aforementioned Ser. Nos. 244,574 and 385,782. In the process of Ser. No. 385,782 the impregnated material after being dried is aerated by directing a current of air through the dried material, and also the material, after passing through the ammonia atmosphere, is exposed to, or contacted by water, e.g., a fine water spray. By conducting the process in this manner the problems caused by the presence of formaldehyde in the dried uncured impregnated material and also after the curing of the monomer on and in the cellulosic material can be substantially obviated.

It is believed that formaldehyde may be formed by decomposition of the unpolymerized monomer, probably poly (hydroxyorgano) phosphonium hydroxide, and that this formaldehyde methylolates the phosphonium materials to form a water soluble reaction product. By removing at least a major portion of this undesirable formaldehyde from the dried material prior to the curing step by aeration, which serves also to rapidly cool the hot dried material emanating from the drier and subsequently rapidly cooling the material after curing with ammonia (an exothermic reaction) it is believed that the problems caused by the undesirable formation of formaldehyde can be substantially prevented.

The treating solution may be applied to the cellulosic material in any convenient manner. For example, the solution may be applied by padding, dipping, spraying, and the like. After impregnation, the excess solution is preferably removed from the material by passing the material through squeeze rolls, centrifuging, wringing, or other methods. Although a wet pick-up of from about 50 to about 200 percent may suitably be used, preferably the material contains about an equal weight, i.e., about 100 percent pick-up, of the treating solution.

The impregnated material is then dried to a residual moisture content of about 0 to about 8 percent and preferably from about 0 to about 3 percent. The drying is carried out in air or in drying oven at temperatures which may vary from ambient to about 125 degrees centigrade. Excessive drying temperatures and times are to be avoided. The drying time may vary according to the drying temperature and also the weight and fibrous nature of the material, as will be obvious to those skilled in this art. The moisture content of the material may be measured by a suitable moisture meter.

The dried material is then aerated as described above by passing a current of air through the material as soon as possible or convenient after leaving the drier. Essentially all of the free formaldehyde which may be present in the dried material is removed from the material.

The aeration step can be carried out by passing the material after drying over a perforated plate or pipe through which a strong current of air is continuously blown or sucked. Preferably the air current is moved by suction. Conveniently this aeration means is located as close as possible and/or convenient to the material exit of the drier. The material is passed over the perforated or slotted air distribution means, a plate, pipes or series of pipes, extending over the width of the fabric and a current of air, flowing at about 1,000 to 3,000 cubic feet per minute, is caused to pass through the material. The time required for this operation is not critical and in general the material is exposed to the current of air for about 0.5 to about 2.0 seconds or more. As will be apparent, the speed of the material running through the processing equipment will determine the exposure time, and is a function of the volume of air and speed of the material. By this means any formaldehyde present in the dried material is rapidly removed by the current of air and also the material is rapidly cooled thereby reducing the formation of additional formaldehyde occasioned by the probable decomposition of the phosphonium compounds.

The aerated impregnated material next is exposed to gaseous ammonia in an enclosed chamber wherein the resin monomer reacts rapidly and substantially completely to form an insoluble polymer within the material. The gaseous atmosphere which comprises at least about 50 percent of gaseous ammonia, and preferably from about 70 to about 95 percent or more of gaseous ammonia provides an effective, efficient and surprisingly rapid reactant for the resin curing step. It has been found that the curing step is completed, under these conditions, in less than about 45 seconds and generally less than about 30 seconds, and as low as 5 seconds, whereas in prior art procedures from about one to about six minutes were required for substantially complete polymerization and curing of the impregnated composition. Under optimum conditions, the procedure of this invention proceeds with the efficient utilization of the gaseous ammonia charged to the process whereas prior art processes often referred up to a 15 fold excess of the ammonia reactant. This huge excess of ammonia presented a serious air pollution problem, which in the present process and apparatus has been eliminated by the highly efficient utilization of the ammonia.

Following the curing step, the material is contacted with water preferably in the form of a fine water spray. Several means for accomplishing this step will be obvious to those skilled in this art. For example a spray head or several heads may be positioned as close as possible and convenient to the material exit means from the curing cabinet either within or outside the cabinet. Most preferably the spraying means is one or several air atomizing water spray heads which are used to supply the water in the form of a atomized spray to the material prior to exiting from the ammonia curing cabinet. Sufficient water should be added to the material to provide a pick-up of about 10 to about 40 percent by weight and preferably from about 20 to about 30 percent by weight pick-up of water. This water not only cools the hot material exiting from the curing cabinet but also results in the immobilization of formaldehyde, if present, and thus prevents its further reaction with the phosphonium salt polymer.

It is believed that the water supplied in this manner and at this stage of the process provides a reaction medium for the formaldehyde to react with ammonia which may be present to form hexamethylene tetramine which latter product does not react the phosphonium salt polymer present in and on the material.

It has been found that further treatment with gaseous ammonia, after contact with water, has a further beneficial effect upon the polymerized material. Treatment with gaseous ammonia for from about 1 to about 10 seconds and preferably about 1 to about 6 seconds reduce further the substantially reduced odor of formaldehyde so that such odor is no longer readily apparent. To gain such further treatment, placement of the water treatment means at a point away from the material exit, so that the material will remain in the enclosed chamber for a time after water treatment, has been found to be a convenient method of achieving this end. Alternatively, the further gaseous ammonia treatment may be accomplished in a separate chamber. Thereafter the wetted material which contains about 10 to about 40% by weight of moisture pick-up is preferably oxidized or scoured, or washed to remove unpolymerized materials and the like. Where the present invention is carried out on yard goods using mill apparatus, this scouring operation may be effected using any of the conventional scouring processes such as rope scouring, open width scouring, jig scouring and the like. The scouring may be conveniently carried out using, e.g. an aqueous solution containing small amounts of sodium carbonate, perborate or peroxide, and synthetic detergents. Preferably this scouring is carried out immediately after the step of contacting the material with water.

The cellulose materials which can be treated to impart flame retardant properties thereto in accordance with this invention include cotton, rayon, paper, jute, ramie, wood and mixtures thereof, and is particularly effective when applied to blends of cellulosics, such as cotton or rayon with synthetic materials, such as nylon, polyesters, acrylics, and with proteinaceous fibers, such as wool, silk, and the like. The process of this invention is particularly effective when applied to the treatment of cellulose/synthetic blended materials such as cotton and rayon containing up to about 80 percent synthetic material.

The solution used to impregnate the textile material comprises poly (hydroxymethyl) phosphonium cation of poly (hydroxymethyl) phosphine and poly (hydroxymethyl) phosphonium cation as an equilibrium mixture. Such solutions are well known in the art. One method of preparation is by reacting a solution of poly (hydroxyorgano) phosphonium salt with up to an equivalent quantity of an organic or inorganic base. Typically, any of the poly (hydroxyorgano) phosphonium salts can be utilized to make the solutions of this process. Common salts which may be employed include, for example, the halides, sulfates, acetates, phosphates, carboxylates, oxalates, lactates, formates, sulfonates, and nitrates. The most often used salts are, however, the halides and the sulfates. Of particular importance are the tetrakis (hydroxyorgano) phosphonium salts having the formula:

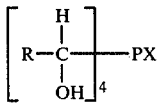

wherein R is selected from the group consisting of hydrogen, lower alkyls having between about 1 and about 6 carbon atoms, halogenated lower alkyls having between about 1 and about 6 carbon atoms, lower alkenyls having between about 1 and about 6 carbon atoms, halogenated lower alkenyls having between about 1 and about 6 carbon atoms, aryls having between about 5 and about 10 carbon atoms, halogenated aryls having between about 5 and about 10 carbon atoms, cycloalkyls having between about 3 and about 6 carbon atoms, halogenated cycloalkyls having between about 3 and about 6 carbon atoms, and X is a halogen, such as chlorine, bromine, fluorine or iodine, a sulfate, oxalate, acetate, and the like. Typical examples of suitable tetrakis (hydroxyorgano) phosphonium compounds are tetrakis (hydroxymethyl) phosphonium sulfate, tetrakis (hydroxymethyl) phosphonium chloride, tetrakis (hydroxymethyl) phosphonium bromide, tetrakis (hydroxymethyl) phosphonium sulfite, tetrakis (alpha-hydroxypropyl) phosphonium sulfate, tetrakis (alpha-hydroxyallyl) phosphonium sulfate, tetrakis (alpha-hydroxybenzyl) phosphonium sulfate, tetrakis (alpha-hydroxymethylcyclohexyl) phosphonium sulfate, tetrakis (alpha-hydroxypropenyl) phosphonium sulfate, tetrakis (alpha-hydroxybutenyl) phosphonium sulfate and mixtures thereof. The phosphonium compounds may be used in monomer form or in a partially polymerized form, so long as they are still solvent soluble. For example, tetrakis (hydroxymethyl) phosphonium sulfate, which is the preferred phosphonium compound, may be heated with or without nitrogen containing materials to effect partial polymerization before dissolving it in the solution.

The solvent may be water or an appropriate non-aqueous solvent such as alcohol, N,N-dimethyl formamide, dimethyl acetamide, and mixtures thereof and the like. Alternatively, the solution may be in the form of an emulsion. Furthermore, the solution may be a reaction product or mixture of the poly (hydroxyorgano) phosphonium cation with an appropriate nitrogen containing material such as urea, guanidines, substituted ureas, melamines, or other amino or amido function containing organic materials or the reaction product of the previously mentioned nitrogen containing materials with aldehydes, preferably formaldehyde. Especially preferred bases for reaction with the salt are alkaline metal hydroxides, alkaline earth hydroxides, salts of weak acids and strong bases, monoalkaline metal salts of dibasic acids, organic tertiary amines such as triethylamine, trimethylamine, and the like. For the purpose of this invention, the active component of the solution or emulsion is considered to be the poly (hydroxyorgano) phosphonium cation. Hereinafter, the active component will be expressed in terms of this component, although it is probable that there is present a mixture of poly (hydroxy organo) phosphine and poly (hydroxyorgano) phosphonium cation.

The pH of the final solution is adjusted to from about 2 to about 9, preferably to from about 4.0 to about 8.1 and most preferably from about 4.5 to about 7.5.

The adjustment of pH may be accomplished by employing a basic catalyst agent which also assists the reaction between the phosphonium salts of the present invention and the textile material. Preferably, the catalyst agent may be applied in a separate step either before, after, or during the application of the phosphonium salt of the present invention.

Basic catalysts which may be employed include, for example, alkali metal or other suitable carbonates, bicarbonates, acetates, phosphates, metasilicates and the like. Particularly suitable catalyst materials have been found to be sodium carbonate, sodium bicarbonate, potassium carbonate, potassium bicarbonate and the monosodium, disodium and trisodium phosphates. Where these materials are added to the textile treating solution, they are preferably present in amounts within the range of about 0.5 to about 20% by weight of the composition.

The second step of the sequential process is contacting the thus treated fabric with a phosphonium salt composition further containing a nitrogen compound copolymerizable with said phosphonium salt. The nitrogen compound should have a replaceable hydrogen in order for it to copolymerize.

By "replaceable hydrogen" means that the hydrogen from the nitrogen containing composition, during the curing reaction of the phosphonium salt bath, will be removed and the nitrogen compound will bond to the phosphonium compound thereby resulting in the polymerization.

Most preferably, the nitrogen compound may be a cyclic nitrogen compound such as the triazines and the methylolated cyclic alkylene ureas. Typical examples of suitable triazines include the methylol melamines, such as mono-, di-, and tri-methylol malamine; modified methylol malamine, such as tri-methylether or tri-methylol malamine, triazones, such as tri-methylol triazone; and mixtures thereof. Typical examples of suitable cyclic alkylene ureas include dimethylol ethylene urea, dimethylol propylene urea, trimethylol acetylene diurene, and the like.

In addition, carbamic acid derivatives may also be employed such as, urea, thiourea, biuret, ethylene urea, dicyandiamide, and the like.

The phosphonium salt composition useful in the second step is the same as those of the first step. The most preferred salts being the tetrakis (hydroxy organo) phosphonium salts including the halides, sulfates, oxalates, acetates, phosphates, carboxylates, lactates, formulates, sulfonates, and nitrates. The solvent and method of application of the composition can be any of the prior art methods as aforedescribed for the first step of the process.

A preferred composition useful in the second application of the phosphorus materials is as follows:

| | % By Weight |
|---|---|
| tetrakis (alpha hydroxy organo) phosphonium sulfate | 10–40% |
| nitrogen containing composition | 5–15% |
| carbamic acid derivative | 1–10% |
| water | Remaining Portion |

While the above preferred composition indicates that the phosphorus compound is a sulfate salt, other salts may be used.

After application of the phosphonium salt composition containing a nitrogen compound copolymerizable therewith, the impregnated textile is usually passed through a squeeze roll or other means removing excess solution. The textile impregnated with the aqueous resin solution may be heated or otherwise treated to remove excess water and to effect curing of the resin on the textile. Drying of the treated cloth can be effected in a conventional forced hot air oven at a temperature from between about 90° and about 110° Centigrade, for between 1 and about 10 minutes, and curing of the resin can be effected in the same apparatus at a temperature of between about 100° and about 150° Centigrade for between about 1 and about 10 minutes, however, any temperature and time conditions under which substantially all of the free water is removed and the resin is cured may be employed. For example, the textile impregnated with an aqueous resin solution may be stored under atmospheric conditions or overnight to effect drying of the cloth. In another modification the dry resin coated textile may be cured in an infra-red oven where the treated cloth is exposed to an elevated temperature, for example between about 500° and about 700° F. for between about 5 and about 10 seconds.

After drying and curing, the resin impregnated cellulosic textile is then scoured or washed to remove unpolymerized materials and the like.

The treatment steps to be followed in second application of the phosphorus composition are:

(1) pad a solution of the phosphorus salt onto the fabric;
(2) dry the fabric;
(3) heat cure the resin;
(4) oxidize or scour the fabric:
(5) wash;
(6) dry.

Most preferably, the total resin add-on to the fabric from both phosphorous composition applications may range from 15–35%. This percent resin add-on breaks down to about 15–25% preferably about 18% from the phosphonium cation composition with about 3–10%, preferably 4–5% for the phosphonium salt composition.

On a percent phosphorous basis, it is preferred that the amount of phosphorous present on the fabric after the first step range up to about 5%, preferably about 2 to about 5% and the amount of phosphorous present on the fabric after the second step range up to about 2%, preferably about 1 to about 2%.

EXAMPLE 1

Four 50/50 polyester/cotton broadcloth samples (3.2 oz/yd$^2$) were treated with the THPOH/Ammonia system, using the following formulation, where all percentages are by weight:

| | Parts by Wt. |
|---|---|
| Tetrakis (hydroxymethyl) phosphonium chloride (80%) | 419 |
| Sodium hydroxide (50%) | 119 |
| Water | 462 |

The fabrics were saturated with this solution, then squeezed between two rubber rolls to a 90% wet pick-up, dried at 200° F. for 1.25 minutes and cured in 90% ammonia atmosphere for 30 seconds. The swatches were then padded through a 6% hydrogen peroxide solution, held for 45 seconds, then rinsed in hot water, and dried. Resin add-ons ranged from 18.3 to 20.3% for the four samples.

Three samples were then post-treated with the following solution, all parts are by weight:

| | A | B | C |
|---|---|---|---|
| tetrakis (hydroxymethyl) phosphonium chloride (80%) | 120 | 100 | 80 |
| trimethylol melamine | 25 | 21 | 17 |
| urea | 20 | 16 | 13 |
| sodium hydroxide (50%) | 21 | 18 | 14 |
| water | 814 | 845 | 886 |

The swatches were dried 2 minutes at 210° F., then heat cured at 320° F. for 2.5 minutes. The fabrics were scoured with 1% hydrogen peroxide, then given a hot water rinse.

The fabrics were then evaluated for durable flame retardancy according to the nightwear standard, FF-3-71, (50 home washes and 50 tumble dryings, wash/wear rating after 5 home washes (AATCC - 124) and strength retention:

| | A | B | C | D |
|---|---|---|---|---|
| sample | | | | |
| resin add-on | | | | |
| THPOH/$NH_3$ | 20.3 | 18.9 | 18.3 | 19.1 |
| tetrakis (hydroxymethyl) phosphonium chloride | | | | |
| heat cure | 10.0 | 8.1 | 7.7 | — |
| Total | 30.3 | 27.0 | 26.0 | 19.1 |
| char. length | | | | |
| initially | 2.6 | 2.8 | 2.7 | 3.1 |
| 50 home washes | 2.9 | 2.6 | 2.8 | Burns |
| wash/wear rating | 3.5 | 3.5 | 3.5 | 3.0 |
| tensile strength retention % | | | | |
| fill | 80 | 84 | 90 | — |
| warp | 74 | 81 | 84 | |
| hand | good | excellent | excellent | |

Thus, those samples which were given the combination treatment were durably flame retardant according to Federal Specification FF-3-71; they possessed adequate Wash wear ratings, strength retention was excellent, and the hand is excellent. The fabric that had only the tetrakis (hydroxymethyl) phosphonium hydroxide/$NH_3$ treatment, was flame retardant prior to washing, but was not flame retardant after laundering.

EXAMPLE 2

Two samples of 50/50 cotton/polyester broadcloth were treated with high levels of the tetrakis (hydroxymethyl) phosphonium hydroxide/ammonia finish. The third sample was treated at a moderate level. These formulations are shown below, all parts and percentages are by weight:

| | A | B | C |
|---|---|---|---|
| Tetrakis (hydroxymethyl) phosphonium chloride (80%) | 560 | 502 | 419 |
| Sodium hydroxide (50%) | 156 | 142 | 119 |
| Water | 284 | 356 | 462 |
| % THPOH in Solution | 40 | 36 | 30 |
| % Resin Add-on | 22.8 | 23.3 | 20 |

Sample C was post-treated with the heat cured tetrakis (hdroxymethyl) phosphonium chloride formulation as described in Example 1, Column C. This increased the add-on to 22.3%. All three samples were then subjected to 10 one hour wash cycles at the boil in 0.25% soda and 0.25% soda ash solution. This test is a more severe test of flame retardant durability then the aforementioned test FF-3-71.

The results are shown below.

| Sample | Treatment | Char. Length, In. After Test |
|---|---|---|
| A | Tetrakis (hydroxy-methyl)phosphonium chloride/$NH_3$ | Burn |
| B | Tetrakis (hydroxy-methyl)phosphonium chloride/$NH_3$ | Burn |
| C | Combination | 2.4" |

It can be seen from Samples A & B that the maximum quantity of tetrakis (hydroxymethyl) phosphonium chloride polymer that can be applied to this blend fabric has been achieved. More concentrated solutions would not produce higher add-ons. This tetrakis (hydroxy methyl) phosphonium hydroxide/$NH_3$ system, then, is not applicable to blends containing 50% or more polyester. Sample C, however, passes the wash test easily. In addition to being unsatisfactory from a flame retardant standpoint, the tetrakis (hydroxy methyl) phosphonium hydroxide/$NH_3$ system alone does not provide sufficient Wash Wear properties to be of commercial use in dress apparel.

EXAMPLE 3

Samples of 50/50 polyester/cotton were treated only with high levels of the tetrakis (hydroxy methyl) phosphonium chloride heat-cured system. The following formulas were used:

| | A Parts by Wt. | B Parts by Wt. |
|---|---|---|
| tetrakis (hydroxy methyl phosphonium chloride (80%) | 360 | 320 |
| sodium hydroxide (50%) | 64 | 57 |
| trimethylol melamine | 75 | 67 |
| urea | 59 | 52 |
| water | 442 | 504 |

The processing steps were identical to those described in Ex. 1. Resin Add-Ons were 27.6% and 23.0% for A and B respectively. The fabrics were then given 50 home washes as specified in the Federal Night Wear Standard FF-3-71. Sample A passed this test with an average char length of 2.4", but sample B failed the test. Both samples, and especially sample "A", were extremely stiff and were judged commercially unacceptable. Thus, this finish alone is not the solution for flame retarding blends containing 50% or more Polyester.

EXAMPLE 4

A 50/50 Polyester/Cotton denim fabric, 7.8 oz/yd$^2$, was treated with the tetrakis (hydroxy methyl) phosphonium hydroxide/$NH_3$ system alone and with the combination system. The formulas are given below. Processing is identical to that described in Ex. 1. Amounts are expressed as parts by weight.

| | A | B a. | B b. |
|---|---|---|---|
| tetrakis (hydroxy methyl) phosphonium chloride 80% | 502 | 446 | 100 |
| Na OH 50% | 142 | 127 | 18 |
| Trimethylol melamine | — | — | 21 |
| Urea | — | — | 16 |
| Water | 356 | 427 | 845 |
| % Resin Add-On | 16.7 | 12.1 | 5.8 |
| Total | | 17.9% | |
| Char Length, In. 10 Boil Cycles | Burn | 0.5 | |
| Wash Wear Rating | 3.0 | 4.0 | |

(a) tetrakis (hydroxy methyl) phosphonium hydroxide/$NH_3$

-continued

| | A | B a. | B b. |
|---|---|---|---|
| (b) tetrakis (hydroxy methyl) phosphonium chloride heat cured | | | |

A 50/50 Polyester/Cotton broadcloth was treated with the tetrakis (hydroxy methyl) phosphonium hydroxide/$NH_3$ system in the normal manner, the fabric having 19.0% final resin add-on. Trimethylol acetylene diurene was substituted for the trimethylol melamine as the cross-linking resin. The following formulas were used, amounts are expressed as parts by weight:

| | A | B | C |
|---|---|---|---|
| tetrakis (hydroxymethyl) phosphonium chloride (80%) | 160 | 120 | 80 |
| trimethylol acetylene diurene (50%) | 84 | 63 | 42 |
| urea | 26 | 20 | 13 |
| sodium hydroxide | 29 | 22 | 15 |
| water | 701 | 775 | 850 |
| | 1000 | 1000 | 1000 |
| % resin add-on (total) | 30.4 | 27.7 | 24.9 |
| char. length after 50 home washings | 2.8 | 2.9 | 3.0 |
| wash/wear rating | 4.0 | 4.0 | 3.5 |

EXAMPLE 6

A 10 oz/yd$^2$ denim blend containing 75% polyester/25% cotton was treated in a pilot plant continuous with the following tetrakis (hydroxymethyl) phosphonium hydroxide/$NH_3$ formula:

| | Part by Wt. |
|---|---|
| tetrakis (hydroxymethyl) phosphonium chloride (80%) | 462 |
| sodium hydroxide | 119 |
| water | 419 |
| | 1000 |

The wet pick-up was 73%. The fabric was dried 3.5 min. at 250° F. to about 5% moisture. The resin was cured in 90% ammonia gas for 12 seconds, oxidized with 7% hydrogen peroxide and rinsed and dried. Resin add-on was 16.5%.

The heat-cured tetrakis (hydroxymethyl) phosphonium chloride formula was then applied:

| | Part by Wt. |
|---|---|
| tetrakis (hydroxymethyl) phosphonium chloride (80%) | 100 |
| sodium hydroxide | 18 |
| trimethylolmelamine | 21 |
| urea | 16 |
| water | 845 |
| | 1000 |

The wet pick-up was 66%. The fabric was dried for 3.5 min. at 250° F., and cured for 30 minutes at 360° F. The fabric was given a light oxidation and rinsed. Additional add-on was 3.7%, for a total of 20.2%. After 50 home washes according to FF-3-71, the char. length was 3.4 inches.

EXAMPLE 7

A light weight (2.6 ox/yd$^2$) 65/35 polyester/cotton shirting was treated with the tetrakis (hydroxymethyl) phosphonium hydroxide/$NH_3$ system to achieve a final resin add-on of 20.7%. This treated fabric was divided into three sections, one left "as is", the other two treated with the tetrakis (hydroxymethyl) phosphonium chloride system.

| | A | B | C |
|---|---|---|---|
| | Parts by Wt. | | |
| tetrakis (hydroxymethyl) phosphonium chloride (80%) | 120 | 80 | — |
| sodium hydroxide (50%) | 22 | 15 | — |
| trimethylol melamine | 25 | 17 | — |
| urea | 19 | 13 | — |
| water | 814 | 875 | — |
| | 1000 | 1000 | — |
| Total resin add-on, % | 27.9 | 24.3 | 20.7 |
| Char. after 50 FF-3-71 home washings, in. | 4.3 | 4.5 | Burn |

It is to be appreciated that the modifications can be made to the process such as subjecting the fabric to a caustic (sodium hydroxide aqueous solution of about 1 to about 10% by weight) step prior to the application of the phosphorous compositions. It has been found that such pre-treatment enhances the flame retarding properties of the treated fabrics. For a more complete discussion on this matter, reference is made to applicant's patent application for Case No. 3523, filed concurrently with this case. The subject matter of said case is hereby incorporated by reference into this case.

It is also to be appreciated that the various other phosphonium salts can be substituted for the salt utilized in the examples without significant obvious effect. The phosphonium sulfate salt is a desirable substitution.

What is claimed is:

1. A process for imparting flame retardant property to cellulose containing textile materials comprising the steps:

(1) treating the cellulosic containing material with a solution containing poly (hydroxyorgano) phosphonium cation;

(2) exposing the treated cellulosic material to an atmosphere containing ammonia to polymerize the phosphonium compound;

(3) treating the cellulosic material containing polymerized phosphonium compound with a solution containing a tetrakis (alpha-hydroxyorgano) phosphonium salt and a nitrogen containing compound copolymerizable with said phosphonium salt, and (4) heating the thus treated cellulosic material to cure substantially all the phosphonium salt composition thereof.

2. The process of claim 1 wherein the phosphonium cation is present in the solution in an amount ranging from 10% to about 40% by weight; the phosphonium salt is present in an amount ranging from about 5% to about 20% by weight.

3. The process of claim 1 wherein the cellulosic material contains at least 20% by weight of a polyester material.

4. The process of claim 2 wherein the phosphorous compounds are tetrakis (hydroxymethyl) phosphonium cation for steps 1 and 3 respectively.

5. The process of claim 1 wherein the solutions in steps 1 and 3 are aqueous solutions.

6. The process of claim 1 wherein the phosphonium salt of Step 2 is cured by heating the treated material to a temperature between about 100° Centigrade to about 700° Centigrade.

7. The process of claim 1, wherein the phosphonium cation solution has a pH ranging from about 2 to about 9.

8. The process of claim 1 wherein the phosphonium salt solution of Step 2 is comprised of the following compositions:

| | parts by weight |
|---|---|
| phosphonium salt | 10% to 40% |
| a nitrogen containing compound copolymerizable with the phosphonium salt | 5% to 15% |
| carbamic acid derivative | 1%–10% |
| water | remaining portion |

9. The process of claim 1 wherein the total resin add-on ranges from about 15 to about 35% by weight.

10. A composition of matter treated according to the process of claim 1.

11. A composition of matter treated according to the process of claim 4.

* * * * *